US006820776B2

(12) United States Patent
Hemming et al.

(10) Patent No.: US 6,820,776 B2
(45) Date of Patent: Nov. 23, 2004

(54) DEVICE FOR DISCHARGING A SPREADABLE MATERIAL

(75) Inventors: Christian Hemming, Oberhausen (DE); Paul Simeria, Erkrath (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/663,096

(22) Filed: Sep. 15, 2003

(65) Prior Publication Data

US 2004/0069814 A1 Apr. 15, 2004

Related U.S. Application Data

(63) Continuation of application No. PCT/EP02/02273, filed on Mar. 2, 2002.

(30) Foreign Application Priority Data

Mar. 13, 2001 (DE) ..... 101 11 898

(51) Int. Cl.[7] ..... B67D 5/42

(52) U.S. Cl. ..... 222/390; 222/386; 401/68; 401/175

(58) Field of Search ..... 222/390–391, 222/386, 560; 401/68–75, 175–176, 172, 98, 19, 30; 132/318, 297

(56) References Cited

U.S. PATENT DOCUMENTS

| | | | |
|---|---|---|---|
| 1,876,797 | A | 9/1932 | Treleven |
| 1,907,376 | A | 5/1933 | Weck |
| 1,969,027 | A | 8/1934 | Morrison |
| 2,079,744 | A | 5/1937 | Maguire |
| 2,421,246 | A | 5/1947 | David |
| 2,589,000 | A | 3/1952 | Vani |
| 2,625,302 | A | 1/1953 | Mahoney |
| 2,717,101 | A | 9/1955 | Van Handel |
| 2,720,966 | A | 10/1955 | Davis |
| 2,770,358 | A | 11/1956 | Keith |
| 3,217,869 | A | 11/1965 | Katz et al. |
| 3,358,699 | A | 12/1967 | Bau |
| 3,507,798 | A | 4/1970 | Egan et al. |
| 3,576,776 | A | 4/1971 | Muszik et al. |
| 3,612,705 | A | 10/1971 | Duval |
| 3,817,887 | A | 6/1974 | Mestetsky |
| 3,828,802 | A | 8/1974 | Spanel |
| 3,907,441 | A | 9/1975 | Idec et al. |
| 4,011,311 | A | 3/1977 | Noomen et al. |
| 4,019,654 | A | 4/1977 | van Manen |
| 4,019,998 | A | 4/1977 | Benson et al. |

(List continued on next page.)

FOREIGN PATENT DOCUMENTS

| | | |
|---|---|---|
| CA | 50425/74 | 12/1990 |
| DE | 1 811 466 | 8/1969 |
| DE | 7 011 820 | 2/1970 |
| DE | 2 035 732 | 1/1972 |
| DE | 2 139 123 | 1/1979 |

(List continued on next page.)

*Primary Examiner*—Frederick Nicolas
(74) *Attorney, Agent, or Firm*—Stephen D. Harper; Glenn E. J. Murphy

(57) ABSTRACT

A device for dispensing solid material from a tube having a longitudinally displaceable internal piston moved by an externally operated spindle threading through the piston. At its base the spindle has a narrowed, non-threaded region, such that when the piston is fully withdrawn into the tube, the threads of the spindle and piston slip if the spindle continues to be rotated. To prevent the piston threads from completely disengaging the spindle threads, the spindle's non-threaded region is shorter than the piston's internal threads. In this way, the spindle will not break even if it continues to be rotated after the piston is fully withdrawn into the tube, yet it readily engages the piston threads when turned in the opposite direction to displace the piston towards the dispensing end of the tube. Thus the device as a whole remains reliably usable.

2 Claims, 1 Drawing Sheet

U.S. PATENT DOCUMENTS

| | | | | | |
|---|---|---|---|---|---|
| 4,182,945 | A | | 1/1980 | McArdle et al. | |
| 4,382,825 | A | | 5/1983 | McCready | |
| 4,521,127 | A | | 6/1985 | Tomburo et al. | |
| 4,580,920 | A | * | 4/1986 | Schmidt | 401/175 |
| 4,664,547 | A | | 5/1987 | Rosenwinkel | |
| 4,812,066 | A | | 3/1989 | Gueret | |
| 4,950,094 | A | | 8/1990 | Yorks | |
| 5,009,534 | A | | 4/1991 | Gueret | |
| 5,102,249 | A | | 4/1992 | Holloway et al. | |
| 5,150,978 | A | | 9/1992 | Stewart et al. | |
| 5,195,555 | A | | 3/1993 | Knapp | |
| 5,336,005 | A | | 8/1994 | Moeck et al. | |
| 5,371,131 | A | | 12/1994 | Gierenz et al. | |
| 5,567,071 | A | | 10/1996 | Lepsius et al. | |
| 5,573,341 | A | * | 11/1996 | Iaia | 401/172 |
| 5,725,133 | A | * | 3/1998 | Iaia | 222/390 |
| 5,733,058 | A | * | 3/1998 | Hofmann | 401/70 |
| 5,842,802 | A | | 12/1998 | Lang et al. | |
| 5,868,510 | A | * | 2/1999 | Lacout et al. | 401/70 |
| 5,879,096 | A | * | 3/1999 | Franta et al. | 401/175 |
| 5,961,007 | A | * | 10/1999 | Dornbusch et al. | 222/386 |
| 6,129,471 | A | | 10/2000 | Lang | |
| 6,193,427 | B1 | | 2/2001 | Benguigui | |
| 6,247,865 | B1 | | 6/2001 | Russell et al. | |
| 6,299,369 | B1 | | 10/2001 | Baines et al. | |
| D456,953 | S | | 5/2002 | Look | |
| 6,409,403 | B1 | | 6/2002 | Woos | |
| 6,417,261 | B1 | | 7/2002 | Maier et al. | |
| 6,550,999 | B2 | * | 4/2003 | Petit et al. | 401/70 |

FOREIGN PATENT DOCUMENTS

| | | |
|---|---|---|
| DE | 195 01 213 A1 | 7/1996 |
| EP | 0 395 914 A1 | 11/1990 |
| EP | 0 405 329 B1 | 4/1993 |
| EP | 0 391 862 B1 | 8/1994 |
| EP | 0 506 300 B1 | 6/1996 |
| FR | 942379 | 2/1949 |
| FR | 1049134 | 12/1953 |
| FR | 2227311 | 4/1974 |
| GB | 1012488 | 12/1965 |
| GB | 1 366 050 | 11/1973 |
| NL | 6616056 | 5/1967 |
| SU | 397536 | 9/1973 |
| WO | WO 90/15762 | 12/1990 |

* cited by examiner

DEVICE FOR DISCHARGING A SPREADABLE MATERIAL

CROSS-REFERENCE TO RELATED APPLICATIONS

This application is a continuation under 35 U.S.C. §365 (c) of International Application No. PCT/EP02/02273, filed Mar. 2, 2002, claiming priority under 35 U.S.C. §119 of German Application No. 101 11 898.8, filed Mar. 13, 2001.

BACKGROUND OF THE INVENTION

This invention relates to a device for dispensing a spreadable (i.e. highly viscous) material. The device comprises a tube-like holding element, in which is arranged an internally screwthreaded, non-rotatable piston-like element which carries the spreadable material. The piston-like element is designed for displacement longitudinally between the tube base of the holding element and the dispensing end by an externally operated pedestal-like control wheel provided at end opposite the dispensing end of the holding element. The pedestal-like control wheel comprises an axially supported, screwthreaded spindle that is mounted for rotation in an opening in the tube base and that co-operates with the internal screwthread of the piston-like element.

A device of the type in question has been known for some time, for example from applicants' DE 195 01 213 C2, which describes an adhesive stick comprising a cylindrical tube of which the open dispensing end is provided with a removable closure cap to stop the adhesive paste accommodated in the tube from drying out when the adhesive stick is not in use. The adhesive paste in the tube is poured into a piston-like element and, together with this piston-like element, is held non-rotatably in the tube and designed for longitudinal displacement in both directions in the tube. The piston-like element is provided—for displacement—with an internally screwthreaded bore that engages a screwthreaded spindle that extends over the entire length of the tube and hence through the adhesive paste. At its end, the spindle merges integrally into a pedestal-like control wheel that resembles a knurled nut and which, at the other end of the tube, is mounted for rotation and projects outwards from the tube at the base thereof. The device is operated by turning the pedestal-like control wheel in one direction or the other while the tube is held firmly, so that the piston-like element and the adhesive paste joined to it are moved in one direction or the other relative to the tube, and adhesive is either dispensed or the adhesive paste is drawn back into the tube.

This known device has been successfully used for some time because it constitutes an easy-to-handle and, at the same time, very stable article. However, it has been found in practice that, unless the device is used properly, the spindle is subjected to such serious torsion if it is turned any further when the piston is in its lowermost position that it breaks off. This results in destruction of the device which thus becomes unusable. The same unwanted effect can also sometimes occur before the filling step of the automated assembly of the device if the tube-like element is moved into the lowermost position by corresponding rotation of the spindle before the device is filled with the spreadable paste.

The problem addressed by the present invention was to improve a device of the type mentioned at the beginning in such a way that torsion of the spindle would be reliably avoided even in the event of incorrect operation and resulting breakage of the spindle.

DESCRIPTION OF THE INVENTION

According to the invention, the external screwthread of the screwthreaded spindle merges in the region adjoining the tube base into a non-screwthreaded region of the spindle that has an external diameter smaller than the internal diameter of the internal screwthread of the piston-like element so that, in the lowermost position of the piston-like element, the spindle is able to slip through relative to the piston-like element if it is rotated any further.

Since the external screwthread of the screwthreaded spindle no longer extends over the entire displacement path of the piston-like element in the device according to the invention, but is missing in the lowermost region so that a screwthread-free region with a smaller external diameter is formed, the spindle is able to slip through relative to the piston-like element if it is rotated any further in the lowermost position of the piston-like element. In this way, the spindle is no longer subjected to torsion and cannot break off, even in the event of incorrect operation, so that the device as a whole remains reliably usable.

In order to prevent the piston-like element or its internal screwthread from moving completely out of contact with the screwthreaded region of the spindle when the piston-like element is in its lowermost position, the length of the screwthread-free region of the spindle is shorter than the length of the internal screwthread of the piston-like element. If then the spindle is turned in the other, opposite direction, the piston-like element can readily be displaced back to the dispensing end because it does not move completely out of contact with the external screwthread of the spindle.

In a particularly preferred embodiment, the height of the screwthread-free region of the spindle is such that, in the lowermost position of the piston-like element, the internal screwthread of the piston-like element remains in contact with the lowermost thread of the spindle. This ensures that the spindle is able to slip through freely relative to the piston-like element and also guarantees that the screwthreads of the piston and spindle do not move completely out of contact.

DESCRIPTION OF THE DRAWINGS

An exemplary embodiment of the invention is described in more detail in the following with reference to the accompanying drawings, wherein.

Figure 1:
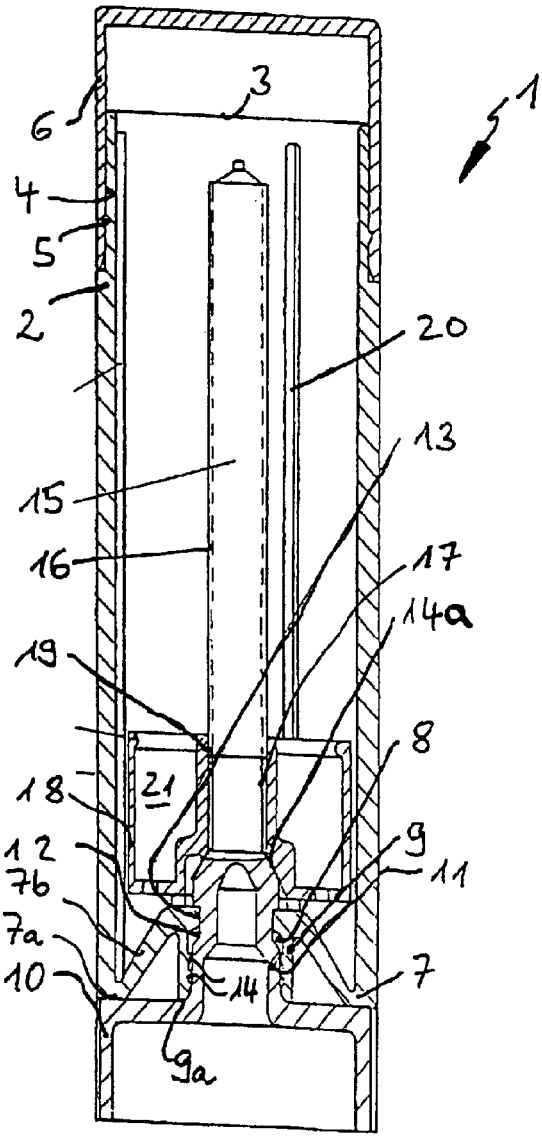
FIG. 1 is a section through a device according to the invention.

A device according to the invention for dispensing a spreadable material is generally denoted by the reference numeral 1 in the drawings and, in the illustrated embodiment, is in the form of an adhesive stick, i.e. the material is an adhesive paste. The device may of course also be designed as a lip-care stick; other applications are also possible.

The device 1 according to the invention firstly comprises a tube-like holding element 2 of which the upper end—open in the in-use position—is denoted by the reference numeral 3. Provided externally on the tube-like holding element 2 at the dispensing end 3 is a taper 4 with an encircling stop bead 5 which enables a removable closure cap 6 to be held tightly in place.

At its end opposite the open dispensing end 3, the tube-like holding element 2 comprises a tube base 7 with a central opening 8. The tube base 7 has a horizontal base region 7*a* and a conical opening region 7*b* which borders the opening 8 and which merges into a tubular region 9 surrounding the opening 8.

In the opening 8 or in the tubular region 9 of the tube base 7, a pedestal-like control wheel 10 is mounted on the holding element 2. To this end, the pedestal-like control wheel 10 is provided on top with a tubular extension 11 provided with an encircling groove 12 in which engages an encircling stop bead 13 of the tube base 7 that borders the opening 8. In addition, guide beads 14 may be provided for further guiding or holding the pedestal-like control wheel 10 in the tubular region 9.

In the position shown in FIG. 1, the pedestal-like control wheel 10 is held axially, but able to rotate, between the stop bead 12 and the free end 9*a* of the tubular region.

The tubular extension 11 of the pedestal-like control wheel 10 merges into a conically tapered region 14*a* and opens, preferably integrally, into a screwthreaded spindle 15 of which the length substantially corresponds to the height of the interior of the holding element 2. The screwthreaded spindle 15 is provided with an external screwthread 16. However, between its externally screwthreaded region 16 and the tapered part 14 of the pedestal-like control wheel 10, the spindle 15 has a screwthread-free section 17 of which the external diameter substantially corresponds to the internal diameter of the external screwthread 16.

If the pedestal-like control wheel 10 with the spindle 15 is, mounted in the holding element 2 by press fitting, a piston-like element 18 with an internal screwthread 19 is introduced from the free dispensing end 3 and screwed onto the screwthreaded spindle 15. The piston-like element 18 is provided externally with a protuberance which engages in a groove 20 extending over the height of the holding element 2 so that the piston-like element 18 is prevented from rotating relative to the holding element 2. By rotation of the screwthreaded spindle 15, the piston-like element 18 is thus longitudinally displaced in one direction or the other relative to the holding element 2.

Internally, the piston-like element 18 comprises a holding region 21 which carries the material (not shown), for example adhesive.

Figure 2:
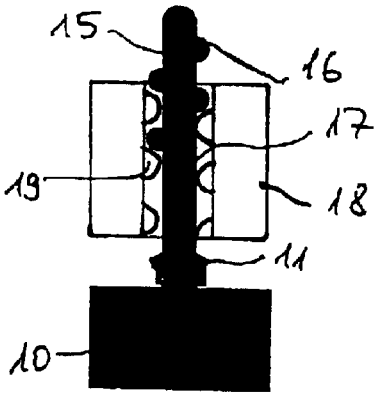
FIG. 2 is a simplified view of the lower part of the spindle with the piston-like element.

As can be seen from FIGS. 1 and 2, the screwthread-free region 17 of the spindle 15 is of such a height that, in the lowermost position of the tube-like element 18, the spindle 15 is able to slip through relative to the tube-like element 18 if it is rotated any further. The height of the screwthread-free region 17 of the spindle 15 is smaller than the height of the internal screwthread 19 of the piston-like element 18 and is preferably such that, in the lowermost position of the piston-like element 18, the internal screwthread 19 of the piston-like element 18 remains in contact with the lowermost thread of the spindle 15.

If, now, the piston-like element 18 is turned into the lowermost position by rotation of the pedestal-like control wheel 10 and if the spindle 15 is rotated further in the same direction in the event of incorrect operation, the spindle 15 is able to slip through freely relative to the piston-like element 18 so that it is not subjected to torsion and, in particular, cannot be broken away from the pedestal-like control wheel 10.

The invention is not of course confined to the illustrated embodiment. Other embodiments are possible without departing from the basic concept of the invention. Thus, the tube base 7 may of course be differently designed and the spindle 15 differently mounted, the only important requirement being that the spindle 15 should have a substantially screwthread-free region 17 at its lower end, as mentioned above.

What is claimed is:

1. A device for dispensing a spreadable material comprising a tubular holding element having a dispensing end and a tube base at an end opposite the dispensing, end, in which the tubular holding element is arranged an internally screwthreaded, non-rotatable piston element that carries the spreadable material and that is displaceable longitudinally from the tube ease of the tubular holding element to the dispensing end by an externally operated control wheel provided at the tube base end of the tubular holding element, the control wheel comprising an axially supported externally screwthreaded spindle that extends rotatably through an opening in the tube base into the tubular holding element and that co-operates with the internal screwthread of the piston element, so that when the piston element is drawn adjacent to the tube base, the spindle is able to slip relative to the piston element if the spindle is rotated any further, wherein the screwthread-free region of the spindle has a smaller length than the internal screwthread of the piston element.

2. The device of claim 1, wherein the internal screwthread of the piston element remains in contact with the thread of the spindle when the piston-element is drawn adjacent to the tube base.

* * * * *